US007566387B2

(12) United States Patent
Nam et al.

(10) Patent No.: US 7,566,387 B2
(45) Date of Patent: Jul. 28, 2009

(54) APPARATUS FOR PRODUCING OZONE BY ELECTROLYSIS

(75) Inventors: Sang Seon Nam, Seoul (KR); Hyeok Choi, Seoul (KR)

(73) Assignee: R to R, Inc., Seoul (KR)

( * ) Notice: Subject to any disclaimer, the term of this patent is extended or adjusted under 35 U.S.C. 154(b) by 130 days.

(21) Appl. No.: 10/563,541

(22) PCT Filed: Jun. 25, 2004

(86) PCT No.: PCT/KR2004/001540

§ 371 (c)(1),
(2), (4) Date: Dec. 24, 2005

(87) PCT Pub. No.: WO2004/113591

PCT Pub. Date: Dec. 29, 2004

(65) Prior Publication Data

US 2006/0193758 A1 Aug. 31, 2006

(30) Foreign Application Priority Data

Jun. 25, 2003 (KR) ..... 10-2003-0041566

(51) Int. Cl.
*C25B 9/10* (2006.01)

(52) U.S. Cl. ..... 204/266; 204/252; 204/263

(58) Field of Classification Search ..... 204/224, 204/252, 263, 266
See application file for complete search history.

(56) References Cited

U.S. PATENT DOCUMENTS 4,162,953 A * 7/1979 De Nora et al. ..... 204/252
4,732,660 A * 3/1988 Plowman et al. ..... 204/265
5,256,268 A * 10/1993 Goto et al. ..... 204/268

* cited by examiner

*Primary Examiner*—Bruce F Bell
(74) *Attorney, Agent, or Firm*—Ober/Kaler; Royal W. Craig

(57) ABSTRACT

The present invention discloses an apparatus for producing ozone by electrolysis of water. The apparatus comprises a pair of frames facing each other, and an anode and a cathode oppositely arranged between the two pieces of frames. Between the anode and the cathode is provided a solid polymer electrolyte membrane for transferring hydrogen ions formed during electrolysis. In addition, an auxiliary electrode is provided between the cathode and the solid polymer electrolyte membrane such that a scale can be formed on the surface of the auxiliary electrode. A spacer 60 is inserted between the anode and the cathode. Tap water as well as pure water and cation-exchanged water can be used as a raw material water to produce high-concentration ozone water. A uniformity of pressure between the electrodes and the solid polymer electrolyte membrane can be achieved, thereby providing for a stable operation.

2 Claims, 4 Drawing Sheets

APPARATUS FOR PRODUCING OZONE BY ELECTROLYSIS

TECHNICAL FIELD

The present invention relates generally to an ozonizer, particularly to an apparatus for producing ozone water by electrolyzing water.

BACKGROUND ART

In general, an ozonizer by electrolysis includes a pair of opposing electrodes and a solid polymer electrolyte therebetween. A desired electric current is applied to the electrodes in water, and a high-concentration of ozone dissolved in water can be produced by electrolysis of water.

Conventionally, ozone water may be produced by two types of methods.

According to one of the conventional methods, ozone is evolved by means of corona-type electrical discharges, and the evolved ozone is fed to and dissolved into water to produce ozone water. This method necessitates a blower for feeding air and a micro-bubbler for facilitating dissolution of ozone into water. However, it leads to increase in the manufacturing cost and decrease in the production efficiency, along with noise associated therewith. In addition, undesired nitrogen oxides are produced during the corona electrical discharge by oxidation of nitrogen in air.

In the other type of method, ozone of molecular state can be produced directly in water, and thus it may solve the problems in the above-described technique. This method is categorized into a membrane type and non-membrane type, depending on the presence of solid polymer electrolyte in the construction of opposing electrodes in water.

In the membrane-type process, which is exemplified by U.S. Pat. No. 4,836,929, a lead electrode and a platinum black electrode serve as an anode and a cathode respectively, and a membrane made of solid polymer electrolyte is inserted therebetween. It is, however, technically very difficult to uniformly install the electrodes and the solid polymer electrolyte. Furthermore, due to non-uniformity such as a localized overpressure during operation, the solid polymer electrolyte can be locally deteriorated during electrolysis, and it results in significant reduction in the life span.

U.S. Pat. No. 4,416,747 discloses an electrode assembly in which the surface of solid polymer electrolyte is coated with a precious metal, such as platinum. However, this electrode assembly cannot be easily manufactured in practice, and the production cost thereof is very high. Moreover, it is technically unstable, which leads to lack of reliability.

On the other hand, during the generation of ozone by electrolysis, the formation of a scale is inevitably associated. In order to avoid the scale formation, the conventional technique in the prior art has used a purified water in which 2+ cation constituents such as calcium and magnesium, which causes the scale, has been removed. There is, therefore, a limitation in the applications thereof.

That is, when the electrolysis takes place without removing 2+ cation such as calcium and magnesium from the feed water, for example, by using a hard acidic cation-exchange resin or a reverse osmosis process, OH− ion generated in the equation (5) is used to precipitate hydroxides as in the equations (6) and (7) so that a scale is formed on the surface of the cathode and thus the efficiency of electrolysis is reduced.

$$2H_2O+2e \rightarrow H_2+2OH- \quad (5)$$

$$Ca_2++2OH \rightarrow Ca(OH)_2(\downarrow) \quad (6)$$

$$Mg_2++2OH \rightarrow Mg(OH)_2(\downarrow) \quad (7)$$

In the case of non-membrane type, which is exemplified by Korean Patent No. 36389 entitled "a method and apparatus for producing ozone in water," a multiple pair of opposing electrodes formed of platinum-group metals are placed in water, and electric current is applied to the opposing electrodes such that a strong electric field can be concentrated therearound. Therefore, ozone can be directly evolved in water.

In the above-described prior art, however, when tap water or similar grade water is employed as the feed water, due to lack of electrolyte for current flow in water, a higher electric voltage is required for the electrolysis of water, thereby increasing the electric power consumption and thus reducing the life of electrodes.

Alternatively, in the case where distilled water or purified water by a cation-exchange resin is supplied, the current-flow though the water via the electrodes is significantly suppressed. Therefore, there is a limitation in practical applications.

As another solution to the prior art problems, Korean patent application No. 10-200-0011202 entitled "An Apparatus for Producing High-Concentration Ozone in Water" proposes a technique, in which a vibrator is mounted inside the electrolytic bath of the ozonizer in order to remove the microbubbles forming and growing on the surface of the electrodes. The mere suppression of bubbles does not become an ultimate solution to the general problems in the prior art.

DISCLOSURE OF INVENTION

It is an object of the invention to provide an apparatus for producing ozone by electrolysis of water, where a scale formation at the cathode can be alleviated, thereby producing high-concentration ozone regardless of the grade of raw material water.

To accomplish the object, according to one aspect of the invention, there is provided an apparatus for producing ozone by electrolysis of water. The apparatus includes an anode for producing oxygen, ozone and other oxides by electrolysis in water, a cathode for producing hydrogen and other products by electrolysis in water, a solid polymer electrolyte membrane disposed between the anode and the cathode for transferring hydrogen ion produced by the electrolysis, and an auxiliary electrode disposed between the cathode and the solid polymer electrolyte membrane. The auxiliary electrode passes hydrogen ion produced at the anode through the cathode, and a scale is formed on the surface of the auxiliary electrode by a reaction of 2+ cation and OH− ion produced at the cathode, thereby alleviating scale formation occurring on the surface of the cathode.

Preferably, the auxiliary electrode has a mesh shape and can be formed of stainless steel, titanium, platinum or platinum coating. The apparatus further comprises a spacer for providing a gap between the solid polymer electrolyte membrane and the anode. The spacer can be formed of teflon.

According to the ozonizer of the invention, a uniformity of mechanical pressure can be achieved between the electrodes and the solid polymer electrolyte membrane so that a localized deterioration can be prevented and a stable operation can be realized. Furthermore, the increase in the electrolytic voltage due to a non-uniform gap with the membrane can be prevented, and the formation of scale on the cathode can be effectively alleviated, thereby enabling the use of tap water, instead of pure water. Therefore, a reliable ozone-generating system having low-cost and high-efficiency can be realized, together with a variety of possible applications thereof.

BRIEF DESCRIPTION OF THE DRAWINGS

Further objects and advantages of the invention can be more fully understood from the following detailed description taken in conjunction with the accompanying drawings in which.

BEST MODE FOR CARRYING OUT THE INVENTION

Referring to the accompanying drawings, the preferred embodiments according to the present invention are described in detail hereafter.

Figure 1:
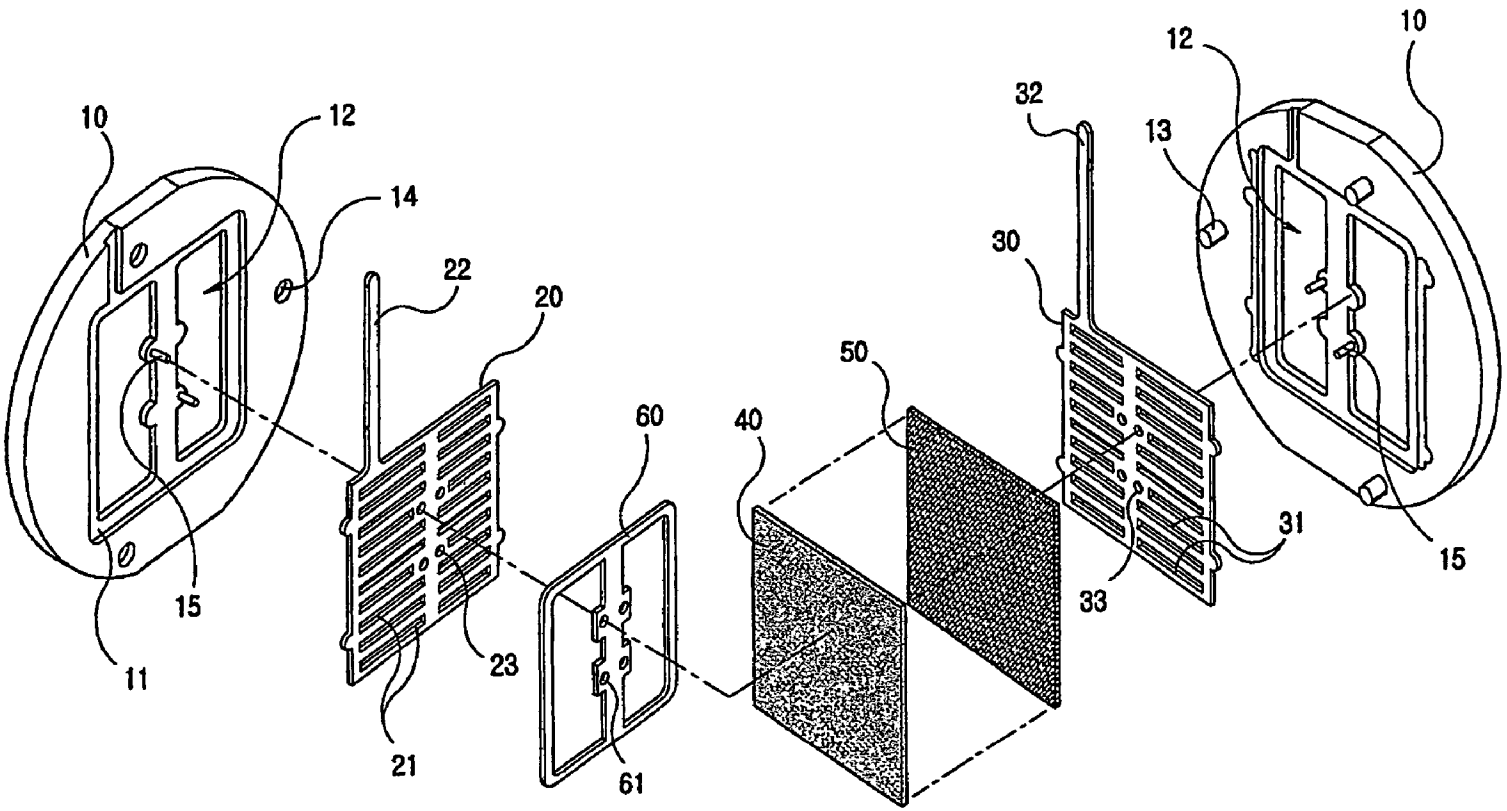
FIG. 1 is a perspective exploded view of an apparatus for producing ozone by electrolysis according to one embodiment of the invention.
Figure 2:
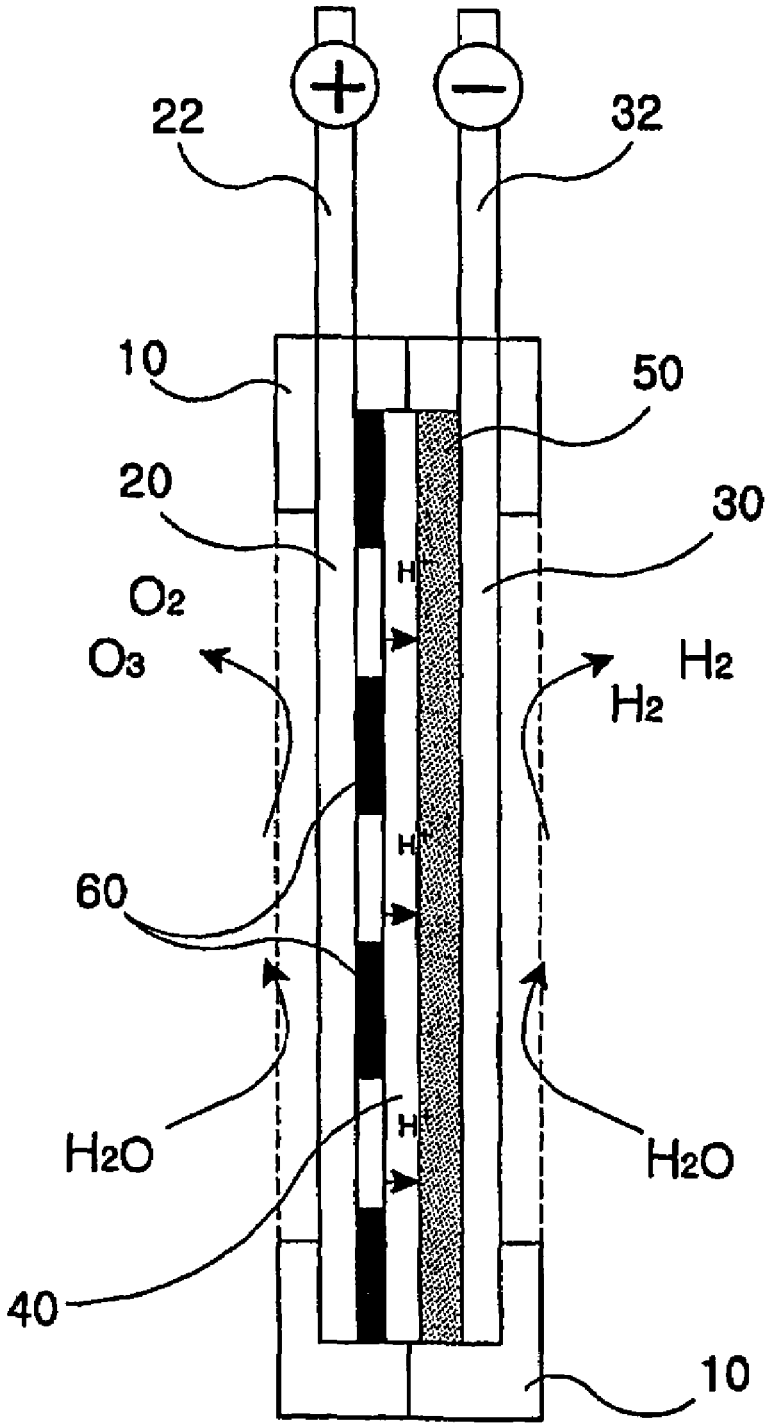
FIG. 2 illustrates an assembled construction of the apparatus shown in FIG. 1.

FIG. 1 illustrates a perspective exploded view of an apparatus for producing ozone by electrolysis according to one embodiment of the invention, which will also be referred to as an "ozonizer". FIG. 2 is an assembled view of the ozonizer in FIG. 1. Referring to FIGS. 1 and 2, the ozonizer of the invention includes a pair of frames 10 facing each other, and an anode 20 and a cathode 30 which are oppositely installed between the pair of frames 10. Between the anode 20 and the cathode 30 is provided a solid polymer electrolyte membrane 40 for transferring hydrogen ions formed during electrolysis. Furthermore, an auxiliary electrode 50 is provided between the cathode 30 and the solid polymer electrolyte membrane 40 such that a scale can be formed on the surface of the auxiliary electrode 50. A spacer 60 is inserted between the anode 20 and the cathode 30. Further details on the ozonizer of the invention will be described hereinafter.

At the anode 20, oxygen and hydrogen are evolved as seen in the equation (1), and ozone is produced by reaction as in the equation (2) and (3).

$$2H_2O \rightarrow O_2+4H^++4e^- \quad (1)$$

$$H_2O+O_2 \rightarrow O_3+2H^++2e^- \quad (2)$$

$$3H_2\text{-}O > O_3+6H^++6e^- \quad (3)$$

At the cathode 30, hydrogen is formed as seen in the equations (4) and (5).

$$nH^++ne^- \rightarrow (n/2)H_2 \ (n=4\sim6) \quad (4)$$

$$2H_2O+2e^- \rightarrow H_2+2OH^- \quad (5)$$

According to the invention, the auxiliary electrode 50 is inserted between the cathode 30 and the solid polymer electrolyte membrane 40 in order to reduce the scale forming on the surface of the cathode 30. I.e., the formed scale is washed away with the water. Therefore, the apparatus of the invention can generate ozone continuously, using tap-water or similar grade water without the necessity of pre-treating the raw material water by means of a hard acidic cation-exchange resin or a reverse osmosis process.

The auxiliary electrode 50 as described above can smoothly transfer hydrogen ion produced at the anode 20 to the cathode 30. As shown the following equations (6) and (7), OH− ion generated at the cathode is reacted with 2+ cations to form the scale. In the present invention, the scale is made to form on the surface of the auxiliary electrode 50, thereby minimizing the amount of the scale forming on the surface of the cathode 30.

$$Ca_2+ +2OH^- \rightarrow Ca(OH)_2 (\downarrow) \quad (6)$$

$$Mg_2+ +2OH^- \rightarrow Mg(OH)_2 (\downarrow) \quad (7)$$

Figure 3:
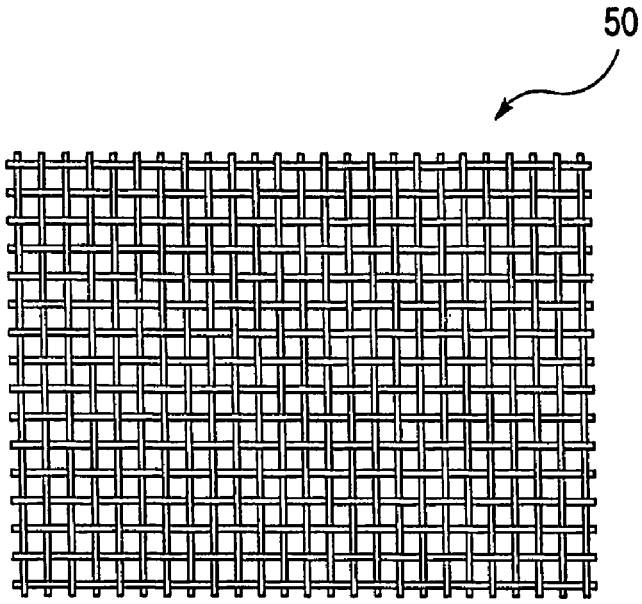
FIG. 3 shows a top plan of an auxiliary electrode according to one embodiment of the invention.

Furthermore, the auxiliary electrode 50 is made in the form of a net, which may be made of a fine wire, such that the formed scale is attached to the auxiliary electrode 50 and then readily released therefrom. FIG. 3 shows a top plan of the auxiliary electrode according to one embodiment of the invention. According to the invention, therefore, the auxiliary electrode 50 and its structural features provide a solution to the problems in the prior art, in which the electrolytic resistance is increased by the deposition and accumulation of the scale. The auxiliary electrode 50 takes desirably in the form of a fine woven wire in order to provide a close contact between the cathode 20 and the solid polymer electrolyte membrane 40.

Figure 4:
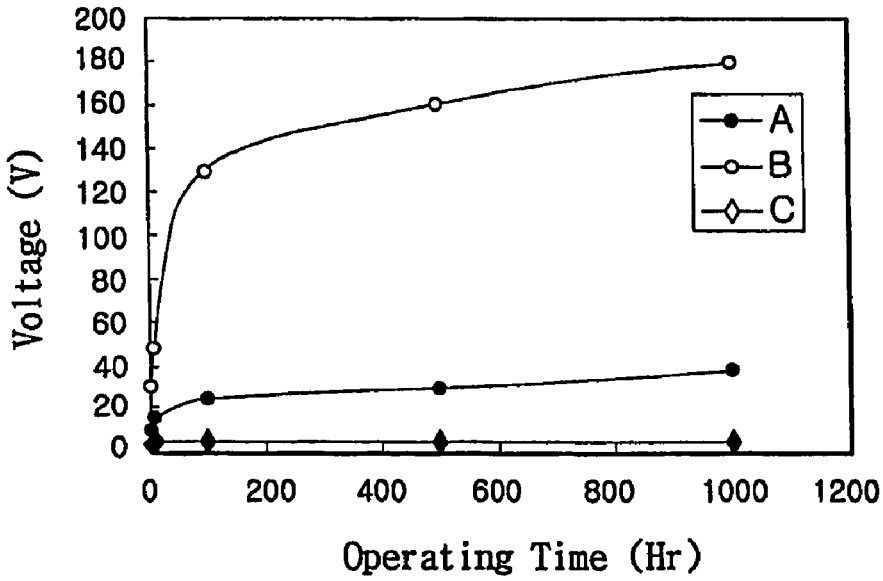
FIG. 4 is a diagram showing the electrolytic resistance in terms of voltage value, depending on the presence of the auxiliary electrode of the invention.

FIG. 4 is a diagram showing the electrolytic resistance in terms of voltage value, depending on the presence of the auxiliary electrode of the invention. As shown in FIG. 4, in order to examine the electrolytic resistance, depending on the presence of the auxiliary electrode, the ozonizer of the invention has been tested by running continuously by means of the constant current process, with and without the auxiliary electrode 50 installed.

As understood from FIG. 4, under the condition of constant current, the voltage applied to the apparatus varies proportionally with the electrolytic resistance. Therefore, the electrolytic resistance can be investigated by the variation in the voltage value.

In FIG. 4, the reference character A denotes the case where the auxiliary electrode 50 and tap water (hardness 65 ppm) are employed, and B denotes the case where tap water (65 ppm) is used without the auxiliary electrode 50. The reference character C denotes the case where the water is pre-treated up to the hardness of 5 ppm by means of a hard acidic cation-exchange resin. The change in the electrolytic voltage during the operation of 1000 hours is shown with respect to each case.

The case C where 2+ cations have been removed from the tap water by the cation-exchange resin shows a most constant electrolytic voltage. Without removing the 2+ cations (in the case A and B), the voltage has been found to be higher than the case C.

As illustrated in FIG. 4, the case A where the auxiliary electrode 50 has been inserted is found to have effectively reduced electrolytic resistance, as compared with the case B without the auxiliary electrode.

The material for the use as the auxiliary electrode 50 must have a strong resistance against acid, alkali, and oxidizing materials, and a good electrical conductivity. Preferred materials are stainless steel, titanium, carbon and the like. The electrode 50 is preferred to have the form of a net having 10-100 mesh. A thickness of 0.1-2.0 mm is suitable for the auxiliary electrode 50.

As described above, in an electrode assembly including the auxiliary electrode 50, the tendency that electrolytic resistance is increased by the scale formation at the cathode 30 can be effectively suppressed, simultaneously while achieving a uniformity of pressure being exerted over the solid polymer electrolyte membrane. As the result, the efficiency of ozone generation can be considerably improved.

Platinum is suitable for the anode 20 and the cathode 30. Alternatively, platinum coating may be applied to an electrode formed of other suitable materials. The anode and cathode are preferred to have the form of a plate and have a certain rate of opening area for effectively releasing the bubbles from the electrodes formed on the surface thereof. Although the mesh shape of electrodes is preferred, careful attention must be made in order to maintain its evenness when assembled with the solid polymer electrolyte membrane, considering the inherent flexibility of the mesh shape. A perforated plate has a disadvantage in that the opening rate may be limited. According to the invention, the opening rate most suitable for the electrodes 20 and 30 is 30-80% of the whole area thereof.

Depending on applications, various materials may be used for the solid polymer electrolyte membrane 40. For example, Nafion (trademark, manufactured by Dupont) is one preferred material. Required physical characteristics for the membrane 40 are a conductivity of 0.083±0.004 S/cm, a unit weight of 0.07-0.23±0.02 g/inch$^2$, and a thickness of 0.05-0.18 mm. The shape of the membrane 40 is preferably of a greatly magnified electrode As illustrated in FIG. 1, the two electrodes 20, 30 and the solid polymer electrolyte membrane 40 are assembled by means of the pair of frames 10, which is made of a material having a good physical and chemical characteristics resistant to deterioration.

The two pieces of frames 10 are assembled in opposite relation to each other. The frame 10 is provided with a groove 11 inside thereof for accommodating the electrodes and holding them in place, and an opening 12 for receiving the raw material water (for example, tap water) therethrough. The frames are assembled and fixed together by means of a projection 13 formed on one of the frames and a hole 14 formed on the other of them.

The anode and cathode 20 and 30 are provided with a plurality of parallel slits 21, which are spaced apart in predetermined intervals. Terminals 22 and 32 are provided to the anode and cathode, respectively, to supply electric current thereto.

The spacer 60 functions to maintain a certain gap between the solid polymer electrolyte membrane 40 and the anode 20. The spacer 60 is made to contact the edge and central portion of the anode 20, and preferred to be made of a tape, sheet, or film of material having a good physical and chemical property resistant to deterioration. Alternatively, a plastic structure may be employed. Preferably, the gap between the spacer 60 and the anode 20 is held to 0.01-0.5 mm.

The anode 20, the cathode 30 and the spacer 60 are provided with assembling holes 23, 33, and 61 respectively in the central area thereof. Each frame 10 is provided with an assembling projection 15 in the position corresponding to that of the assembling holes 23, 33 and 61. When the electrodes 20, 30 and the spacer 60 are assembled with the frames 10, therefore, the assembling projections 15 are made to be inserted into the assembling holes such that all the components can be fixed and held in right places.

The solid polymer electrolyte membrane 40 is placed adjacent to the anode 20, and the auxiliary electrode 50 adjacent to the cathode 30. The solid polymer electrolyte membrane 40 and the auxiliary electrode 50 are placed adjacent to each other in such a manner as to face each other.

The spacer 60 and the auxiliary electrode 50 are placed respectively both sides of the solid polymer electrolyte membrane 40 such that uniform pressure can be achieved between the solid polymer electrolyte membrane 40 and each electrode 20 and 30, thereby providing for a stable operation of the apparatus.

The electrode assembly having the above-describe construction is placed in water, and a positive direct current is applied to the anode 20 and a negative direct current is applied to the cathode 30. As the result, the electrochemical reactions as expressed by the equations (2) and (3) occur to produce a high-concentration of ozone dissolved in water.

Figure 5:
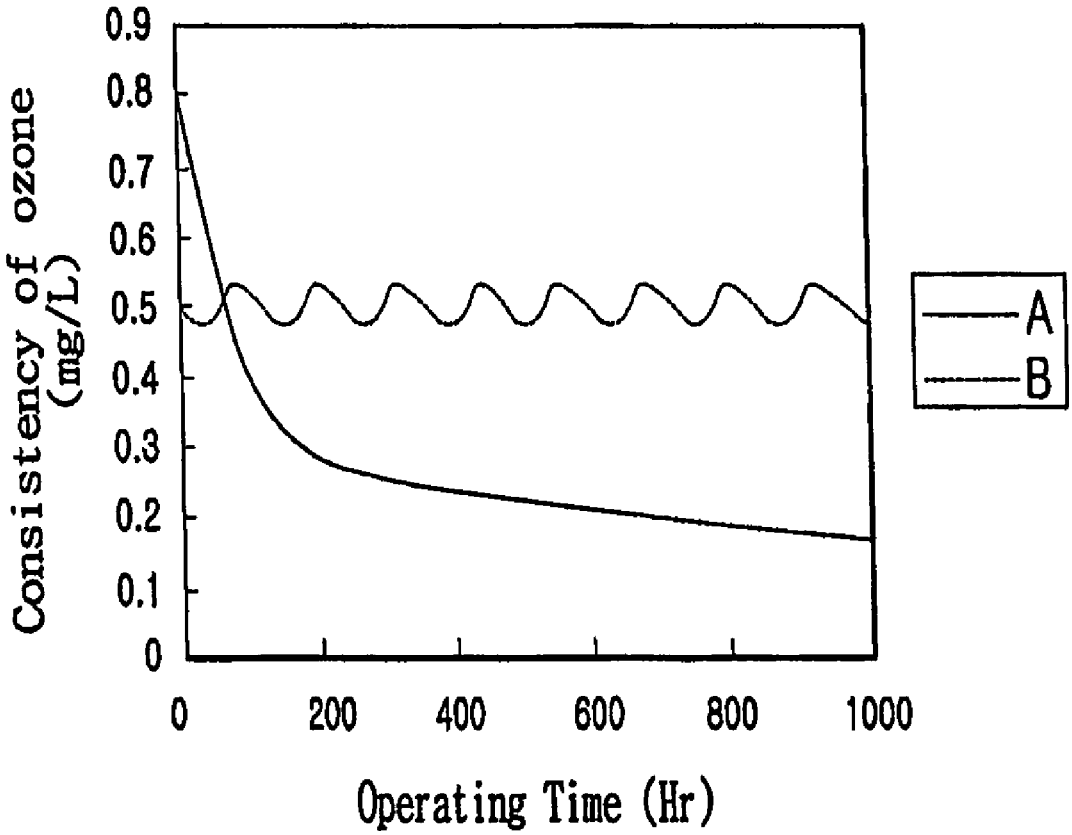
FIG. 5 is a diagram showing the concentration of ozone produced according to the invention, in cases of the constant current process and the variable current process.

The current may be supplied through two types of processes. In the first process, a constant current, which is predetermined depending on the system characteristics, is supplied during the whole period of operation. In the second, the electrolytic resistance, which varies with the property of water, is measured, and the supplied current is varied with the measured resistance. FIG. 5 is a diagram showing the concentration of ozone produced according to the invention, in cases of the constant current process and the variable current process. In FIG. 5, the graph A denotes the constant current process and the graph B denotes the variable current process.

INDUSTRIAL APPLICABILITY

As described above, according to the ozonizer of the invention, a uniformity of mechanical pressure can be achieved between the electrodes and the solid polymer electrolyte membrane so that a localized deterioration can be prevented and a stable operation can be realized. Furthermore, the increase in the electrolytic voltage due to a non-uniform gap with the membrane can be prevented, and the formation of scale on the cathode can be effectively alleviated, thereby being able to use tap water, instead of pure water. Therefore, a reliable ozone-generating system having low-cost and high-efficiency can be realized, together with a variety of possible applications thereof.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An apparatus for producing ozone by electrolysis of water, the apparatus consisting of:

a) an anode for producing oxygen, ozone by electrolysis in water;

b) a cathode for producing hydrogen by electrolysis in water, c) a solid polymer electrolyte membrane disposed between the anode and the cathode for transferring hydrogen ion produced by the electrolysis;

d) a polytetrafluoroethylene spacer for providing a gap between the solid polymer electrolyte membrane and said anode; and e) an auxiliary electrode sandwiched between the cathode and the solid polymer electrolyte membrane and in direct contact there between, wherein the auxiliary electrode passes hydrogen ion produced at the anode through the cathode, and wherein a scale is formed on the surface of the auxiliary electrode by a reaction of 2+ cation and OH− ion produced at the cathode, thereby alleviating scale formation on the surface of the cathode, and wherein the auxiliary electrode has the form of a mesh net having 10~100 meshes and a thickness of 0.1~2.0 mm.

2. An apparatus according to claim 1, wherein the auxiliary electrode is formed of stainless steel, titanium, platinum or platinum coating.

* * * * *